United States Patent [19]

Finsterwalder

[11] Patent Number: 4,811,541

[45] Date of Patent: Mar. 14, 1989

[54] THREADED BAR

[76] Inventor: Ulrich Finsterwalder, Pagodenburgstr. 8, 8000 Munich 60, Fed. Rep. of Germany

[21] Appl. No.: 40,783

[22] PCT Filed: May 15, 1986

[86] PCT No.: PCT/DE86/00207

§ 371 Date: Mar. 9, 1987

§ 102(e) Date: Mar. 9, 1987

[87] PCT Pub. No.: WO86/06777

PCT Pub. Date: Nov. 20, 1986

[30] Foreign Application Priority Data

May 15, 1985 [DE] Fed. Rep. of Germany ..... 3517638

[51] Int. Cl.[4] ..... E04C 5/03; E01D 11/00

[52] U.S. Cl. ..... 52/737; 52/740

[58] Field of Search ..... 52/735, 736, 737, 738, 52/739, 740, 733

[56] References Cited

U.S. PATENT DOCUMENTS

| | | | |
|---|---|---|---|
| 3,376,686 | 4/1968 | Salm | 52/737 |
| 3,561,185 | 2/1971 | Finsterwalder | 52/740 |
| 3,782,839 | 1/1974 | Majewski | 52/726 |
| 4,056,911 | 11/1977 | Tani | 52/740 |

FOREIGN PATENT DOCUMENTS

| | | | |
|---|---|---|---|
| 184711 | 2/1956 | Australia | 52/740 |
| 464437 | 3/1946 | Belgium . | |
| 1659125 | 7/1970 | Fed. Rep. of Germany . | |
| 1409114 | 8/1973 | Fed. Rep. of Germany . | |
| 1784630 | 2/1974 | Fed. Rep. of Germany . | |
| 1109237 | 1/1956 | France . | |
| 1189577 | 10/1959 | France . | |
| 2315589 | 1/1977 | France . | |
| 222644 | 10/1968 | U.S.S.R. | 52/737 |
| 238757 | 7/1969 | U.S.S.R. | 52/738 |
| 835934 | 5/1960 | United Kingdom . | |
| 881839 | 11/1961 | United Kingdom . | |
| 150451 | 9/1970 | United Kingdom . | |

*Primary Examiner*—John E. Murtagh

*Attorney, Agent, or Firm*—Davis, Bujold & Streck

[57] ABSTRACT

A concrete-reinforcement bar, especially a tension bar, provided with hot-rolled, helically-arranged ribs, which are located on two mutually-facing sides of the periphery of the bar and form parts of a thread. The ribs of the thread extend over roughly a third of the periphery of the bar and are inclined toward one another with their front faces which merge into the smooth bar surface of the core cross section. In order to improve the fatigue strength, and mechanical strength, and to simplify the production of the threaded bars and reduce the required tolerances, the cross-section of the bar has a regular, smooth undulating profile in an axial plane in the region of each rib (2); the wave-shaped tops of the ribs and the valleys between the ribs thus form cavities in the otherwise circular core cross-section. The cavities penetrate into the core cross-section only at localized points.

5 Claims, 2 Drawing Sheets

THREADED BAR

The invention, according to claim 1, refers to a concrete reinforcement bar that is a threaded bar, and especially a spreader bar.

Threaded bars of that kind have been disclosed in German Pat. No. 17 84 630. Said threaded bar has hot-rolled, helically extending ribs situated on two opposite sides of the bar periphery and forming part of a thread. The ribs each extend in full height only over about one third of the bar periphery and are inclined against each other by their front faces that convert into the smooth bar surface of the cross section of the core. The ribs, which are rolled on the circular core cross section, have a trapezoidal cross section with slightly rounded flutes.

Threaded bars of that kind are used, for instance, as loose reinforcement bars in steel concrete structures, or as spread bars in prestressed concrete structures, or also, for instance, in cables of cable-staid bridges.

An important criterion for the excellence of the threaded bar, especially in case of loose reinforcement bars, is the fatigue strength which depends not only on the quality of the steel but also especially on the transition between the ribs and the bar core. Due to the trapezoidal cross section of the ribs in the already known threaded bar, a notch effect appears in the transition of the ribs to the pin cores whereby the fatigue strength is reduced. This is a deficiency, especially for the normal loose reinforcement in steel concrete, since it gives steel concrete structural parts in which alternative loads have a very large proportion in the total load of the threaded bar and the reinforcement bars are accordingly exposed to strong tension fluctuations. Especially when the tension fluctuations are positive and negative load alternations or bending moments in which cases the reinforcements act alternatively as traction and pressure reinforcements, as it substantially occurs in live loads in bridge beams, the possible stress reversal between ribs and bar cores is reduced. Such positive and negative load alternations are especially critical in the field of sleeve joints in which both threaded bars are screwed to each other. Due to the shape of the threaded ribs and of the corresponding screw thread in the sleeves, the bars and the sleeves must be made with relatively greater tolerance, whereby the sleeve joint has relatively great play. In the load alternations involved, the reinforcement on said sleeve joints becomes weakened.

If the threaded bars are used as spread bars, then this deficiency is not so serious since the threaded bar is always under tension. The tension oscillations, due to load alternation, more or less make up only a small fragment of the whole tension.

However, when those threaded bars are used, especially in cables, tension oscillations can appear, depending on the intended use, that require a maximum fatigue strength from the spreader bars also. Bending moments are to be especially mentioned in the area of the point of support of the threaded bars.

Problems also arise in the manufacture of the already known threaded bar. Thus, on account of the trapezoidal cross section of the thread ribs, the rolls with which the threaded pins are produced can only be made by hand. Besides, the narrow rounding on the flutes between thread ribs and bar cores forbid the use of mechanized cutting tools. The relatively high thread ribs, with steep sides, are difficult to roll and during the rolling operation are fully filled with material only when quite a specific narrow temperature range is maintained. This requires long experience of the rolling mill personnel and rejected material must be expected. Different ways have been sought to reduce said problems in the rolling operation. One threaded bar resulting therefrom, which also is used in the practice, has been described in U.S. Pat. No. 4,056,911.

Depressions are dug between the thread ribs in this threaded bar, in the circular core cross section on both sides of the interface of top and bottom rolls, a longitudinal rib resulting between said depressions into which the thread ribs run. But is has been shown that intersection longitudinal and transverse ribs are disadvantageous, since the brittle fracture sensitivity is thereby increased and the threaded bar gives a higher fatigue failure.

However, the shaping of said threaded bar is advantageous since during the hot rolling the thread ribs are more easily filled with material, thus reducing the number of rejects.

The invention is based on the problem of indicating a threaded bar of the kind in question, which can be easily produced, has a high mechanical strength and fatigue strength, even in the presence of load alteration, and requires tolerances that can be reduced, especially in the field of joints such as sleeve joints or attachments points.

Accordingly, the cross section of the thread ribs has a smooth course, a depression respectively being provided between adjacent thread ribs which smoothly joins up the course of the ribs. These ribs are superposed on the otherwise rounded core cross section, the depressions situated between the ribs meshing in the core cross section. The flat depressions convert with an almost constant transition into the surface of the core cross section. The flat depressions act in the rolling operation as pressure points by which the thread ribs are more easily and uniformly completely filled with material. The lowest point of the depression is in the longitudinal symmetrical plane of the threaded bar containing the center of the thread ribs. Pairs of opposite depressions serve as pressure points. The filling of the ribs during the rolling operation is favored, in addition, by the rounded shape in the area of the rear of the thread ribs. Besides, the cross sectional surface of the threaded bar is practically constant over its length, which is likewise advantageous for the rolling operation.

The front sides of the thread ribs are inclined against each other like the threaded bar disclosed in Pat. No. 17 84 630. This is necessary to make exit of the threaded bar from the rolls possible following the hot rolling and later to precisely direct the threaded bar.

The regularly smoothly helical course of the ribs and the attached depressions in the longitudinal symmetrical plane of the threaded bar cutting into the ribs can be composed, for instance, of two circle segments; a course that substantially follows a sine path is also possible.

With such molding of the threaded bar, its fatigue strength and its mechanical strength also are practically not impaired when compared to a bar of circular cross section, since no notches exist in the critical areas and intersecting transverse and longitudinal ribs are absent.

Due to the depressions, practically no weakening of the cross section takes place since a thread rib on the radially opposite side of the threaded bar stands opposed to each depression and the thread ribs together with the bar core contribute to transmitting the tensional forces.

It is also possible to reduce the required tolerances for sleeve joints with this molding of the threaded bar so that even threaded bars composed via sleeve joints in loose reinforcements can be better used. The possibility of reducing the tolerances of the threaded bars and sleeves derives from the fact that the tools needed for producing the threaded bar especially the rolls, have a longer service life on account of the lack of flutes and edges; besides, the rolls can be made mechanized. The use of cutter tools is likewise possible.

The invention is explained in more detail in an embodiment with reference to the drawing. In the drawings.

Figure 1:
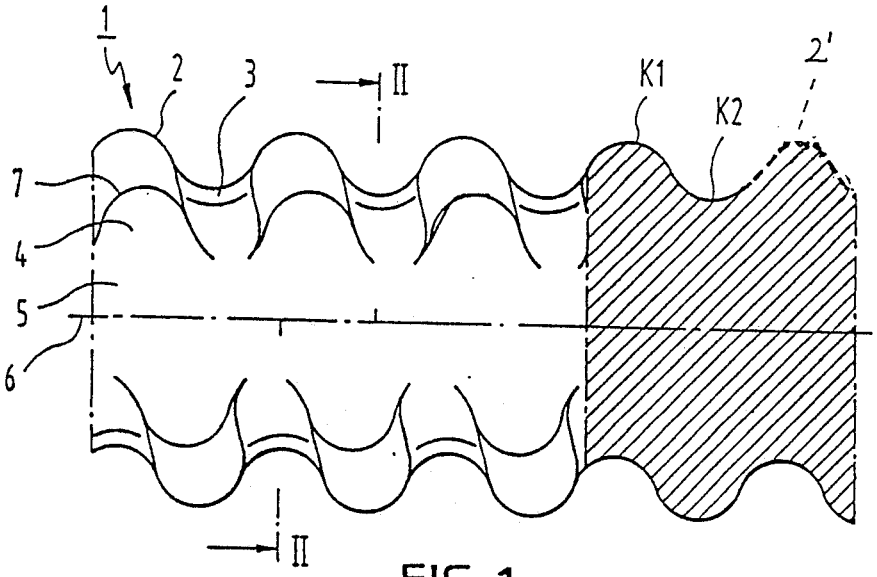
FIG. 1 is a view of a threaded bar according to the invention having a partial longitudinal cross section.
Figure 2:
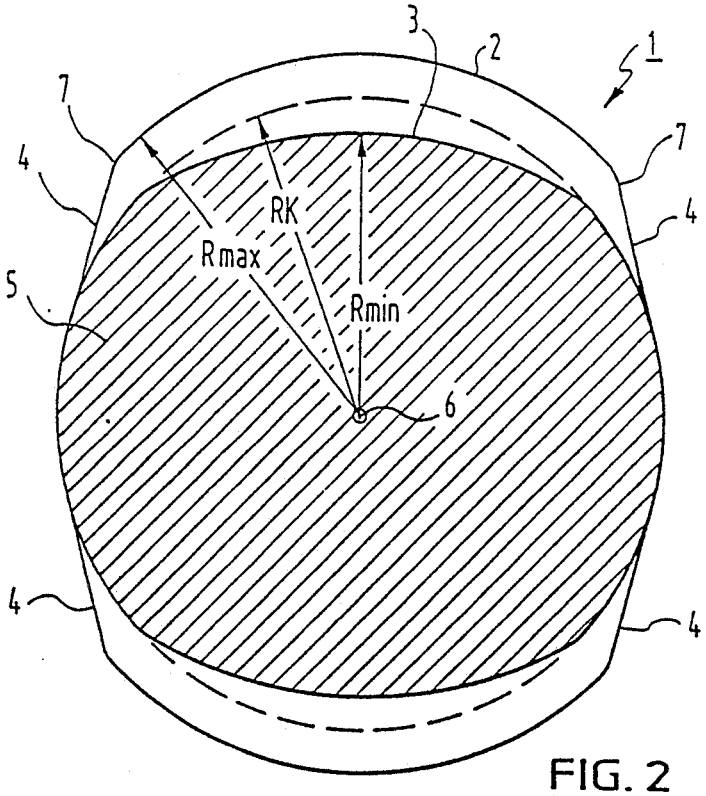
FIG. 2 is a cross section through the threaded bar along II—II in FIG. 1.

In FIG. 1, part of a threaded bar 1 with thread ribs 2 is shown with depressions 3 therebetween. The thread ribs 2 extend on both sides of the threaded bar 1, each substantially over one third of the bar periphery, and front faces 4, inclined against each other, convert into the otherwise circular bar core 5. The depressions 3 mesh in the bar core 5. The course of the thread ribs 2 and the depressions in a longitudinal section containing the central axis 6 of the threaded bar 1 is uniformally helical and is composed, for instance according to FIG. 1, of two circular segments K1 and K2 so that no notches or fluting result during the rolling operation. As shown in FIG. 2, the edges 7 of the thread ribs 2, in the transition into the inclined front surfaces 4, are rounded.

Figure 3:
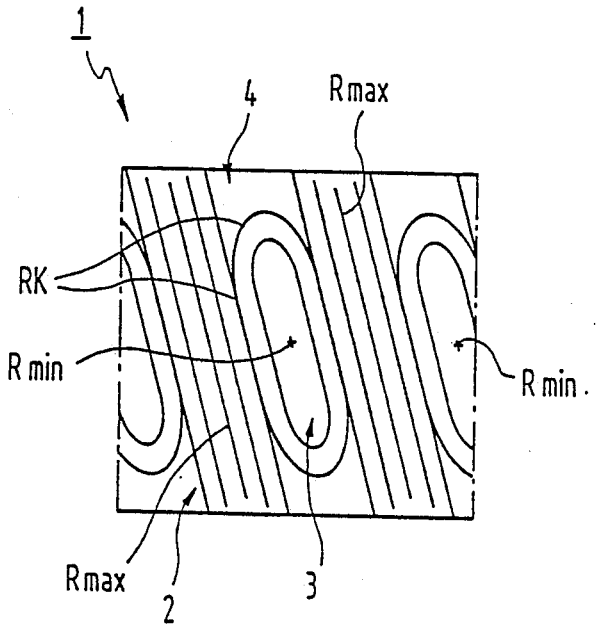
FIG. 3 is a topview of a threaded bar according to the invention.

In FIG. 3 are shown places having equal radii of the threaded bar, among others, the R max line corresponding to the maximum radius of the threaded bar in the highest area of the thread ribs, the RK line corresponding to the radius of the bar core and to the lowest point of the depression, R min corresponding to the minimal radius of the threaded bar. A few intermediate lines, each having the same radius, are likewise marked. The soft and smooth transition between the thread ribs and the depressions and between the depressions and the bar cores can be seen here. The height of the thread ribs, as a rule, is chosen larger than the depth of the depressions respectively compared to the core cross section.

Accordingly, the cross sectional shapes of the ribs and the depressions do not have to be equal. Thus, substantially trapezoidal ribs in cross section and rounded on the upper edges are possible, as shown in dotted lines in a place in FIG. 1.

The shape of the depressions is also given as an example. It is essential that they mesh locally into the core cross section between thread ribs and thus act as pressure points. The ribs are dimensioned in a manner such that during the rolling operation they are entirely filled with material due to the engagement in the core cross section between the ribs.

It is obvious that the illustration and dimensions in the drawings are by way of example.

I claim:

1. In a ribbed bar, especially a tensioning bar, having hot-rolled, helically running ribs situated on two opposite sides of the bar periphery defining an interrupted thread configuration, said ribs extending in full height only over one third of the circumference of the bar and having end surfaces converting tangentially into a smooth side core surface of the bar, whereby the periphery of the bar between the end surfaces of the ribs on opposite sides of the bar defines an arc of a circle, thereby defining a circular core cross-section, the improvement comprising:

said bar having, in a longitudinal section in an axial plane through the region of said ribs, a regular and smooth sinusoidal undulation (K1, K2) corresponding to the outer periphery of the ribs and to the troughs therebetween with smooth transition between adjacent troughs and ribs, wherein the troughs between the ribs form depressions in the circular core cross-section of the bar, the lowest point of the depressions being in the longitudinal symmetrical plane of the bar containing the center of the ribs, thereby acting as pressure regions during a hot-rolling process to uniformly and completely form the ribs, wherein a rib is located radially opposite each depression, each said depression converts, on its outer edges near the end surfaces of the ribs, into said core cross-section and the cross sectional area of the bar is substantially constant over the length of the bar.

2. A threaded bar according to claim 1, characterized in that the helical course is composed of two circular segments (2, 3) wherein one circular segment defines said ribs (2) and the other circular segment defines said depressions (3).

3. A threaded bar according to claim 1, characterized in that said helical course follows a sine path.

4. A threaded bar according to claim 1, characterized in that said helical course is substantially trapezoidal in the area of said ribs (2').

5. A threaded bar according to claim 1, characterized in that the transition is rounded (at 7) between said thread ribs (2) and their inclined front faces (4).

* * * * *